US008816602B2

(12) United States Patent
Van Doorn

(10) Patent No.: US 8,816,602 B2
(45) **Date of Patent: *Aug. 26, 2014**

(54) DEVICE AND METHOD FOR CONTROLLING A LIGHTING SYSTEM BY PROXIMITY SENSING OF A SPOT-LIGHT CONTROL DEVICE AND SPOTLIGHT CONTROL DEVICE

(75) Inventor: Markus Gerardus Leonardus Maria Van Doorn, S-Hertogenbosch (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 13/417,622

(22) Filed: Mar. 12, 2012

(65) Prior Publication Data

US 2012/0169254 A1 Jul. 5, 2012

Related U.S. Application Data

(63) Continuation of application No. 12/306,020, filed as application No. PCT/IB2007/052374 on Jun. 20, 2007, now Pat. No. 8,134,461.

(30) Foreign Application Priority Data

Jun. 30, 2006 (EP) ..... 06116403

(51) Int. Cl.
*H05B 37/02* (2006.01)
*G08B 1/08* (2006.01)

(52) U.S. Cl.
USPC ..... 315/297; 315/155; 315/291; 315/292; 315/293; 315/316; 340/539.17; 340/539.22; 340/539.23; 340/539.26; 340/332

(58) Field of Classification Search
USPC ..... 315/155, 291, 294, 295, 316, 297; 340/332, 539.17, 539.22, 539.23, 340/539.26, 539.3
See application file for complete search history.

(56) References Cited

U.S. PATENT DOCUMENTS

| | | | | |
|---|---|---|---|---|
| 6,079,862 | A | 6/2000 | Kawashima et al. | |
| 6,404,079 | B1 | 6/2002 | Hsieh | |
| 6,710,346 | B2 | 3/2004 | Brewington et al. | |
| 7,186,003 | B2 | 3/2007 | Dowling et al. | |
| 7,309,965 | B2 * | 12/2007 | Dowling et al. | 315/318 |
| 7,633,406 | B2 * | 12/2009 | Miki | 340/9.1 |
| 2003/0028260 | A1 | 2/2003 | Blackwell | |
| 2003/0222587 | A1 | 12/2003 | Dowling et al. | |
| 2004/0105264 | A1 | 6/2004 | Spero | |
| 2005/0041161 | A1 | 2/2005 | Dowling et al. | |

(Continued)

FOREIGN PATENT DOCUMENTS

| | | | |
|---|---|---|---|
| WO | 0213218 | A1 | 2/2002 |
| WO | 0213490 | A2 | 2/2002 |
| WO | 03078894 | A1 | 9/2003 |

*Primary Examiner* — Douglas W Owens
*Assistant Examiner* — Thai Pham
(74) *Attorney, Agent, or Firm* — Yuliya Mathis

(57) ABSTRACT

Disclosed are methods and apparatus for controlling a lighting system by proximity sensing of a spotlight control device, particularly to controlling a spotlight generated by a lighting system such as a large LED lighting array by means of a spotlight control device. A device is provided for controlling a lighting system by proximity sensing of a spotlight control device, wherein a predefined area around the spotlight control device is illuminated if a proximity sensor signals presence of the spotlight control device within the predefined area.

12 Claims, 1 Drawing Sheet

(56) References Cited

U.S. PATENT DOCUMENTS

2005/0128751 A1 6/2005 Roberge et al.
2006/0022214 A1 2/2006 Morgan et al.
2008/0290818 A1 11/2008 Fontijn
2009/0026978 A1* 1/2009 Robinson ..... 315/294

* cited by examiner

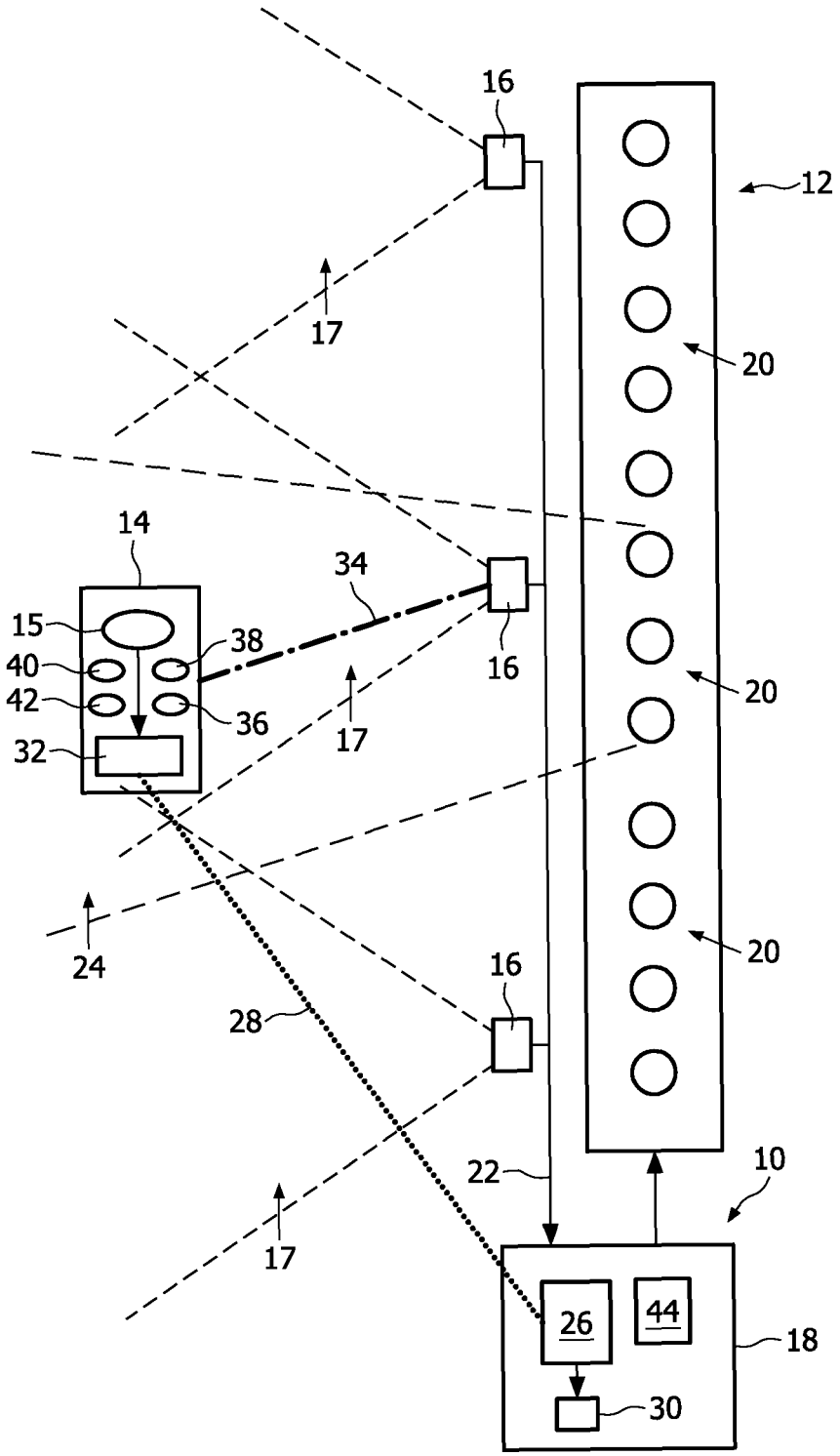
16
12
17
20
14
34
15
38
40
16
42
36
20
17
32
24
20
16
28
22
10
17
26
44
18
30

DEVICE AND METHOD FOR CONTROLLING A LIGHTING SYSTEM BY PROXIMITY SENSING OF A SPOT-LIGHT CONTROL DEVICE AND SPOTLIGHT CONTROL DEVICE

CROSS-REFERENCE TO RELATED APPLICATIONS

This application is a continuation under 35 U.S.C. §120 of U.S. patent application Ser. No. 12/306,020 to be issued as U.S. Pat. No. 8,134,461 on Mar. 12, 2012, which is a national stage application under 35 U.S.C. §371 of International Application No. PCT/IB2007/052374 filed on Jun. 20, 2007, and published in the English language on Jan. 3, 2008, as International Publication No. WO/2008/001277, which claims priority to European Application No. 06116403.4 filed on Jun. 30, 2006, incorporated herein by reference.

FIELD OF THE INVENTION

The invention relates to controlling a lighting system by proximity sensing of a spotlight control device, particularly to controlling a spotlight generated by a lighting system such as a large LED lighting array by means of a spotlight control device. The invention also relates to a light switch for application in such a device and a spotlight control device for controlling a lighting system.

BACKGROUND OF THE INVENTION

Advances in solid-state lighting have made it possible to embed LEDs (Light Emitting Diodes) in a many different sorts of materials. The low cost and high lifespan of LEDs make large LED arrays equipped for example in ceilings or walls economically feasible. However, the control of the light generated by such a large light-emitting array mounted in the ceiling is a complex technical problem, particularly if parts of a light emitting array should be independently controllable, for example independently turned on or off. US 2003/0028260 A1 discloses a lighting control system having a processor associated with a memory storing at least one lighting program. With a user interface, e.g. a button or dial, a program selection may be made or a lighting control feature may be altered.

SUMMARY OF THE INVENTION

It is an object of the present invention to provide an improved device and method for controlling a lighting system. In order to achieve the object defined above, the invention provides a device for controlling a lighting system by proximity sensing of a spotlight control device, wherein the device comprises the following characteristic features:

- at least one proximity sensor for sensing the spotlight control device within an area in the proximity of the lighting system, and
- a light switch being adapted for controlling lighting devices of the lighting system depending on a signal of the at least one proximity sensor such that a predefined area around the spotlight control device is illuminated if the at least one proximity sensor signals presence of the spotlight control device within the predefined area.

In order to achieve the object defined above, the invention further provides a method for controlling a lighting system by proximity sensing of a spotlight control device, wherein the method comprises the following characteristic features:

- at least one proximity sensor senses the spotlight control device within an area in the proximity of the lighting system, and

- a light switch controls lighting devices of the lighting system depending on a signal of the at least one proximity sensor such that a predefined area around the spotlight control device is illuminated if the at least one proximity sensor signals presence of the spotlight control device within the predefined area.

The characteristic features according to the invention provide the advantage that a lighting system containing a large array of lighting devices such as LEDs may easily be controlled without turning on individual switches. With the invention, a lighting system may automatically illuminate a certain area if a spotlight control device is in reach of the lighting system. If a lighting system contains for example a large array of LEDs for illumination, with the LEDs distributed over a large area, the invention may switch on only a subgroup of the LEDs for illuminating the predefined area around the spotlight control device. Thus, the invention helps to save several switches which would be required for switching on and off the subgroups of LEDs in a large array of LEDs.

The term "lighting system" as used herein comprises a system for illumination, particularly containing several lighting devices, for example a large array of LEDs (light emitting diodes) or other lighting devices such as halogen bulbs.

The term "proximity sensor" means a sensor which is able to supervise a certain predefined area for a spotlight control device. Particularly, such a sensor is adapted to detect only spotlight control devices in its surveillance area. A proximity sensor in the context of this invention may be a simple passive receiver for a signal sent out from the spotlight control device, or may be a more complex "active" sensor which sends out itself a signal for detecting the presence of a spotlight control device in its surveillance area. In the most simple implementation, a proximity sensor is implemented as an antenna or an infrared receiver for receiving signals from a spotlight control device.

The term "light switch" as used herein means a kind of intelligent or smart light switch, i.e., not only a simple electromechanical switch for switching a lighting device on or off, but an electronic switch containing for example a microcontroller and memory means storing for example illumination settings. Such a light switch may be also programmable in the context of this invention, for example with certain illumination configurations. The programmable light switch may be for example programmed over a Personal Computer (PC) executing a certain software for configuring a complex lighting system.

The term "spotlight control device" as used herein means a kind of a remote control for controlling a lighting system. Particularly, it may be regarded as a small device containing electronic circuitry, for example a microcontroller, and communication means such as a signal transmitter and/or receiver in order to be able to communicate with a light switch of a lighting system. It may also contain position detection means which may communicate the position of the spotlight control device to a proximity sensor.

According to an embodiment of the invention, the light switch may be further adapted to switch off the lighting devices if the at least one proximity sensor does no longer signal presence of the spotlight control device within the predefined area. In other words, the functionality of the light switch is not limited to switching on the lighting devices depending on the presence of the spotlight control device, but also to switch them off. Thus, a fully automatic control of lighting devices of a complex lighting system is possible without requiring any interaction of a user except carrying the spotlight control device. In this way, a user can create or destroy multiple illumination spots in an office or room with a single device, namely the spotlight control device.

According to a further embodiment of the present invention, the device may comprise a receiver adapted to receive a light control signal for toggling an illumination control indicator, and wherein the light switch controls the lighting devices depending on the status of the illumination control indicator. For example, the illumination control indicator may be used to determine whether the illumination created by the presence of a spotlight control device will be switched off or "destroyed" if the spotlight control device is taken away. A typical application of the illumination control indicator would be to indicate that an illumination should be kept and not switched off if the spotlight control device is taken away. Thus, it is in principle possible to illuminate certain areas without requiring that a spotlight control device is always present.

According to a further embodiment of the present invention, the at least one proximity sensor may be adapted to detect a presence signal from the spotlight control device. For example, the spotlight control device may periodically transmit the presence signal so that a proximity sensor is able to detect the signal by listening to it.

According to an embodiment of the invention, the presence signal may be at least one of a radio signal, a light signal, or a sound signal. In case of a radio signal, it may be a signal transmitted in for example the ISM (Industrial Scientific Medical) band. In case of a light signal, it may be for example an infrared signal as used in infrared remote controls. And in case of a sound signal, it may be for example a very high frequency sound signal which may not be heard by human beings.

According to an embodiment of the invention, the at least one proximity sensor may comprise a near field communication (NFC) device, for example a Bluetooth® communication module. A NFC device means that it may only detect signals within a limited area in its close proximity, for example within a radius of about several meters around the NFC device.

The at least one proximity sensor may also use real-time location-aware sensing technologies based on ultrawide band or ultrasound according to an embodiment of the invention. These sensing technologies allow to measure the position of tagged objects such as the spotlight detection device within the centimeter range. This allows a very accurate detection of the position of the spotlight control device and, thus, a very accurate control of the lighting.

According to an embodiment of the invention, the at least one proximity sensor may be also adapted to transmit a detection signal for a spotlight control device within its supervised area. This detection signal may be for example sent out periodically and allows spotlight control devices to detect that they are in the supervised area of a proximity sensor. Thus, the spotlight control device may be for example reply to the detection signal in order to create an illumination in the predefined area around itself.

According to an embodiment of the invention, a light switch for application in a device according to the invention is provided, wherein the light switch is adapted to store and load a lighting configuration in a memory of the light switch.

According to a further embodiment of the invention, a spotlight control device is provided which is adapted for use with a device for controlling a lighting system according to the invention and which may comprise a memory button and signaling means which may be activated by pressing the memory button and which are adapted to generate a light control signal upon activation which may be received and processed by the light switch in that the light switch remembers the current illumination even if the at least one proximity sensor does no longer signal presence of the spotlight control device within the predefined area.

Such a spotlight control device is optimized for interaction with a device for controlling a lighting system by proximity sensing of the spotlight control device and offers the advantage that for an illumination the presence of the spotlight control device in the predefined area of the illumination may not be required when the memory button is pressed and the light switch may be programmed in such that it remembers the current illumination. Remembering the current illumination may mean either storing settings for the current illumination (also called the illumination configuration) in the light switch or simply keeping the current illumination. By storing the settings in the light switch, it may be for example possible to easily instruct the light switch to load the stored settings and to implement the corresponding illumination, for example by pressing a button on the light switch and, thus, not requiring a spotlight control device.

According to an embodiment of the invention, the spotlight control device may further comprise a beam width button, and wherein the signaling means may be activated by pressing the beam width button and are further adapted to generate a light control signal upon activation of the beam width button which may be received and processed by the light switch in that the width of the beam of the lighting devices for illuminating the predefined area may be changed.

According to an embodiment of the present invention, the spotlight control device may further comprise a beam intensity button, and wherein the signaling means may be activated by pressing the beam intensity button and are further adapted to generate a light control signal upon activation of the beam intensity button which may be received and processed by the light switch in that the intensity of the beam of the lighting devices for illuminating the predefined area may be changed.

According to an embodiment of the invention, the spotlight control device may further comprise at least one beam color button, and wherein the signaling means may be activated by pressing the at least one beam color button and are further adapted to generate a light control signal upon activation of the at least one beam color button which may be received and processed by the light switch in that the color of the beam of the lighting devices for illuminating the predefined area may be changed.

According to an embodiment of the invention, the spotlight control device may further comprise a configuration button, and wherein the signaling means may be activated by pressing the configuration button and are further adapted to generate a light control signal upon activation of the configuration button which may be received and processed by the light switch in that a certain lighting configuration may be stored in or load from a memory of the light switch In the method according to an embodiment of the invention, the light switch may switch off the lighting devices if the at least one proximity sensor does no longer signal presence of the spotlight control device within the predefined area.

According to a further embodiment of the invention, a computer program is provided, wherein the computer program may be enabled to carry out the method according to the invention when executed by a computer. For example, the computer program may implement the light switch for controlling the lighting devices of the lighting system. In order to implement this, the computer program may be implemented to receive signals from proximity sensors and generate digital control signals for switching on and off the lighting devices depending on the received proximity sensor signals. The generated digital control signals may be output over an interface of a computer executing the computer program to a lighting system such as a large LED array.

According to an embodiment of the invention, a record carrier such as a CD-ROM, DVD, memory card, floppy disk or similar storage medium may be provided for storing a computer program according to the invention.

A further embodiment of the invention provides a computer which may be programmed to perform a method according to the invention and may comprise proximity sensing means and light switching means for controlling lighting devices of a lighting system. The light switching means may be for example implemented by an interface card for coupling the computer with a lighting system containing several lighting devices.

These and other aspects of the invention will be apparent from and elucidated with reference to the embodiment(s) described hereinafter.

The invention will be described in more detail hereinafter with reference to exemplary embodiments. However, the invention is not limited to these exemplary embodiments.

BRIEF DESCRIPTION OF THE DRAWING

FIG. 1 shows a block diagram of an embodiment of a lighting system and a device for controlling a lighting system by proximity sensing of a spotlight control device according to the invention.

DETAILED DESCRIPTION

FIG. 1 shows a lighting system 12 comprising a LED array which consists of hundreds or thousands of high intensity LEDs 20 as lighting devices that can each be turned on/off individually. The LED array may be programmed with a spot light control device 14 and can be switched on/off with a light switch 18. The light switch 18 is a kind of controller which is adapted for controlling the LEDs of the LED array. It should be noted that a light switch in the context of the invention is not an end-user switch since it would be to laborious for an end-user to switch on or off each LED of a large LED array with dozens or even thousands of LEDs individually.

A device 10 for controlling the lighting system 12 comprises three proximity sensors 16 and the light switch 18. The light switch 18 is adapted to individually control the LEDs 20, i.e., can independently switch on and off each LED 20 of the lighting system 12, thus, being able to create a kind of spotlight.

Each of the three proximity sensors 16 supervises a certain predefined area 17. The supervision areas 17 are shown as funnel-like shaped, but in practice the shape of these areas 17 depend on the kind of proximity sensor 16. For example, the proximity sensor 16 may be a radio frequency receiver with an antenna. Then the area 17 is determined by the receiving characteristic of the antenna which may be sphere-like shaped. If the proximity sensor 16 is an infrared sensor, the area 17 is determined by the receiving characteristic of the IR sensor which may be more funnel-like shaped. The proximity sensors 16 are coupled to the light switch 18 and signal a presence of the spotlight control device 14 within their predefined areas 17 supervised by the proximity sensors 16.

Several methods may be applied for detecting a spotlight control device 14 within the predefined area, as described above. In FIG. 1, the spotlight control device 14 is adapted to generate and transmit a presence signal 34 via a radio frequency (RF) communication connection with the proximity sensors 16. The presence signal 34 is transmitted via a NFC device of the spotlight control device 14. However, also other methods for detecting a spotlight control device 14 are possible such as a kind of request-and-answer method where the lighting system 12 periodically sends out detection signals and a spotlight control device 14 receiving such a detection signal may answer with a corresponding reply signal. The spotlight control device 14 may be also location-aware and send its coordinates to the LED array, for example if a user presses a button of the spot light control device 14. The LED array can translate the coordinates and update the state of the LEDs in the LED array (e.g. switch on or switch off some LEDs, depending on the location of the control device and the previous state of the array). Furthermore, it is possible to use real-time location-aware sensing technologies based on ultra-wide band or ultrasound in order to accurately detect the position of the spotlight control device. Commercially available solutions using these sensing technologies are offered by companies such as Ubisense (www.ubisense.net) or Sonitor (www.sonitor.com). The offered solutions may be used as proximity sensors for the invention and offer a measurement accuracy within the centimeter range.

As soon as a proximity sensor 16 detects the spotlight control device 14 within the supervised predefined area 17, it transmits a signal to the light switch 18. The light switch then switches on the LEDs 20 of the lighting system 12 which are located near the proximity sensor 16 and illuminate a predefined area 24 around the spotlight control device 14.

Another feature is saving the configuration to the light switch 18. Programming the LED array can take time and is something end-users will usually only want to do once. The light switch 18 may be programmed with different user profiles associated with respective spotlight control devices of different users. For example, a user may program the light switch 18 such that a larger predefined area 24 around her/his spotlight control device 14 is illuminated than another user who prefers a smaller predefined illumination are 24. In order to accomplish this, the light switch 18 may be adapted to store in a memory 44 different user profiles associated with different spotlight control devices 14, and load from the memory 44 a stored user profile when receiving a spotlight detection signal from a proximity sensor 16. Both functions—storing and loading a certain configuration may be initiated by pressing a certain button of the spotlight control device 14, the configuration button 42. Pressing the configuration button 42 activates the signaling means 32 to generate a light control signal 28 which may be received and processed by the light switch 18 in that a certain lighting configuration may be stored in or load from the memory 44 of the light switch 18. Loading a stored configuration could be also initiated automatically without requiring the pressing of a button when a spotlight control devices 14 enters a predefined area 17 and a proximity sensor 16 signals this event to the light switch 18, or when a user switches the light switch 18 on. In order to implement the before described functionality, the light switch 18 contains some "intelligence" in the form of a microcontroller and a memory storing a program to be executed by the microcontroller and implementing the before described functionality.

Furthermore, the light switch 18 may comprise a functionality to upload programmed settings to a PC or even a light switch (panel). Using Near Field Communication the spotlight control device 14 could also instruct the light switch 18 to download the current configuration from the LED array and store it in the light switch memory 44. When the spotlight control device 14 is brought in the proximity of the lighting system, this light switch 18 may be turned automatically on, and it may automatically load the appropriate configuration and program the LED array in correspondence with the configuration, i.e. control the single LEDs of the LED array. Alternatively, the LED array could create a profile for a session and associate the profile to the light switch 18 so that the light switch 18 only needs to store a few bytes.

In order to avoid that the spotlight control device 14 must always be present for illumination of the predefined area 24, which can be very annoying, a user may for example want to create light in a chair where he wants to read. Therefore, the lighting system 12 may have an illumination control indicator 30 which may be implemented by a memory or a certain area in a memory. The spotlight control device 14 comprises a memory button 15 that a user can press to indicate that the lighting system 12 should remember to illuminate a certain location, even if the user takes away the spotlight control device 14 (to use it somewhere else for example). The same memory button 15 could also be used to forget a previously set spot light. This works as follows: When the user moves the spotlight control device 14 in the supervised area 17 of a proximity sensor 16 and presses the memory button 15, signaling means 32 of the spotlight control device 14, for example a NFC device, are activated and generate a light control signal 28. This light control signal 28 is transmitted to a receiver 26 of the light switch 18. The receiver 26 then toggles the illumination control indicator 30. If the illumination control indicator 30 stores a "1", the light switch 18 leaves the illumination switched on even if the spotlight control device 14 is moved out of the predefined area 17. On the other hand, if the illumination control indicator 30 stores a "0", the light switch 18 switches the illumination off when the spotlight control device 14 is no longer detected within a predefined area 17.

The spotlight control device 14 further contains are a series of buttons that allow a user to specify the beam width (beam width button 36), its intensity (beam intensity button 38), and color (beam color button 40). These buttons may be implemented as knobs in order to increase or decrease a characteristic of the generated illuminating spotlight 24. For example, by turning a knob for adjusting the beam width clockwise, the beam width is increased from for example a single LED (the one directly above the spot light control device 14) to its adjacent LEDs (and so on). By turning the knob further to the right, increasingly larger circles or rectangles are activated (turn the knob anti-clockwise to reverse the effect). By turning the intensity knob clockwise, the intensity of the LEDs is increased (anti-clockwise: decreased intensity). Color knobs could be used to control the color of the beam. One possible configuration could be Red, Green and Blue knobs that can each be turned to increase/decrease this component's contribution in the overall light setting. Another possible configuration could be Hue, Saturation and Value knobs to control a HSV color space.

This invention could be used to control large indoor or outdoor LED matrices and associate configurations to light switches.

The invention has the main advantage that it allows to control complex lighting systems containing dozens or even thousands of lighting devices such as large LED arrays with one device, the spotlight control device. The spotlight control according to the invention frees a user from the annoying job of individually programming and switching on and off of single lighting devices of a lighting system.

At least some of the functionality of the invention such as functionality of the light switch, or the method for controlling a lighting system by proximity sensing of a spotlight control device may be performed by hard- or software. In case of an implementation in software, a single or multiple standard microprocessors or microcontrollers may be used to process a single or multiple algorithms implementing the invention.

It should be noted that the word "comprise" does not exclude other elements or steps, and that the word "a" or "an" does not exclude a plurality. Furthermore, any reference signs in the claims shall not be construed as limiting the scope of the invention.

The invention claimed is:

1. A device for controlling a lighting system by proximity sensing of a spotlight control device, the device comprising:

at least one proximity sensor for sensing the spotlight control device within an area in the proximity of the lighting system, and adapted to transmit a detect signal, and a light switch controller adapted to control a plurality lighting devices of the lighting system depending on the detect signal of the at least one proximity sensor such that a predefined area around the spotlight control device is illuminated if the at least one proximity sensor signals presence of the spotlight control device within the predefined area;

wherein the light switch controller is configured to switch off the plurality of lighting devices if the at least one proximity sensor no longer signals presence of the spotlight control device within the predefined area;

the light switch controller having a receiver receiving a light control signal for toggling an illumination control indicator, wherein the light switch controller modifies the lighting devices output depending on the status of the illumination control indicator.

2. The device of claim 1, wherein the presence signal is at least one of a radio signal, a light signal, or a sound signal.

3. The device of claim 2, wherein the at least one proximity sensor comprises a near field communication device.

4. The device of claim 2, wherein the at least one proximity sensor uses real-time location-aware sensing technologies based on ultrawide band or ultrasound.

5. The device of claim 1, wherein the at least one proximity sensor is adapted to transmit a detection signal for the spotlight control device within its supervised area.

6. The device of claim 1, wherein the light switch is adapted to store and load a lighting configuration in a memory of the light switch controller.

7. A spotlight control device in combination with a device for controlling a lighting system, comprising:

at least one proximity sensor of the device for controlling a lighting system for sensing the spotlight control device within an area in the proximity of the lighting system, the proximity sensor including a transmitter to transmit a detect signal;

a light switch of the device for controlling a lighting system for controlling a plurality of lighting devices of the lighting system depending on a signal of the at least one proximity sensor such that a predefined area around the spotlight control device is illuminated if the at least one proximity sensor signals presence of the spotlight control device within the predefined area, a memory button of the spotlight control device, and signaling means of the spotlight control device activated by pressing the memory button and configured to generate a light control signal upon activation, the light control signal received and processed by the light switch in that the light switch-remembers the current illumination for the plurality of lighting devices even if the at least one proximity sensor no longer signals presence of the spotlight control device within the predefined area.

8. The spotlight control device in combination with a device for controlling a lighting system of claim 7, further comprising at least one of a beam width button, a beam intensity button, and beam color button; and wherein the signaling means are activated by pressing the at least one of beam width button, a beam intensity button, and beam color button; and are further adapted to generate a light control signal upon activation of the at least one of the beam width button, the beam intensity button, and/or beam color button received and processed by the light switch.

9. The spotlight control device in combination with a device for controlling a lighting system of claim 8, further comprising a configuration button and wherein the signaling means are activated by pressing the configuration button and are further adapted to generate a light control signal upon activation of the configuration button which may be received and processed by the light switch in that a certain lighting configuration may be stored in or load from a memory of the light switch.

10. A lighting system, comprising:

a spotlight control device and configured to transmit a presence signal;

a plurality of proximity sensors, said sensors each adapted to sense said spotlight control device within a predefined surveillance area in the proximity of the lighting system, a light switch in electrical communication with lighting devices of the lighting system, wherein said light switch manipulating said lighting devices depending on one or more signals from said proximity sensors such that a predefined illumination area around the spotlight control device is illuminated if at least one of said proximity sensors signals presence of the spotlight control device within its said predefined area, wherein its said surveillance area overlaps with said predefined illumination area.

11. The lighting system of claim 10, wherein said predefined surveillance area of some of said proximity sensors overlaps with said predefined surveillance area of other of said proximity sensors.

12. The lighting system of claim 10, wherein said light switch is configured to no longer illuminate said predefined illumination area if said at least one proximity sensor no longer signals presence of said spotlight control device within its said predefined surveillance area.

* * * * *